US005971831A

United States Patent [19]

Hsu

[11] Patent Number: 5,971,831

[45] Date of Patent: Oct. 26, 1999

[54] LEAKAGE PREVENTING STRUCTURE FOR WATER BALL DECORATION

[76] Inventor: Shun-Hsi Hsu, No. 17, Lane 99, Pei-Yuan Street, Tainan, Taiwan

[21] Appl. No.: 08/987,639

[22] Filed: Dec. 9, 1997

[51] Int. Cl.[6] ..... A63H 3/52; G09F 19/00

[52] U.S. Cl. ..... 446/267; 40/406; 428/11

[58] Field of Search ..... 446/267; 40/406, 40/407, 408, 409, 411, 412; 428/11; 277/407, 625, 630, 637

[56] References Cited

U.S. PATENT DOCUMENTS 3,062,557 11/1962 Underwood ..... 277/630
3,100,648 8/1963 Lee et al. ..... 277/630
3,446,507 5/1969 Ulics ..... 277/630 X
5,286,535 2/1994 Hou ..... 428/11
5,775,014 7/1998 Lin ..... 40/406

*Primary Examiner*—Kien T. Nguyen
*Attorney, Agent, or Firm*—Rosenberg, Klein & Bilker

[57] ABSTRACT

A leakage preventing structure for water ball decorations includes an reinforcing ring fitting and rotated to fix in an anti-leak rubber plug combined in a lower portion of a glass dome filled with a liquid and a decorative figure placed in the glass dome of the water ball decoration. Then the reinforcing ring properly ring properly expands and forces the anti-leak rubber plug contact tightly the glass dome so as to strengthen preventing function of liquid leakage from the glass dome.

3 Claims, 4 Drawing Sheets

LEAKAGE PREVENTING STRUCTURE FOR WATER BALL DECORATION

BACKGROUND OF THE INVENTION

This invention relates to a leakage preventing structure for water ball decorations, particularly to one having excellent function of leakage prevention.

A conventional water ball decoration shown in FIG. 6 is very common, consisting of a base 1, a glass dome 2, and an anti-leak rubber plug 3. A rotating ing mechanism is contained in the base 1, not included in this application and not shown in Figures. The glass dome 2 is filled with a liquid, having an open lower side 21 for a anti-leak rubber plug 3 to fit and adhered closely therein to prevent the liquid in the dome 2 from leaking out. A decorative FIG. 31 is housed in the glass dome and fixed on the rubber plug 3. The rubber plug 3 has an annular curved projection 33 on an outer annular surface to engage an annular convex 22 formed in the open lower side of the glass dome 2, for increasing mutual contact tightness.

However, the conventional water ball decoration described above may still happen to have its leakage prevention not enough to hamper the liquid in the glass dome from leaking out. In addition, the rubber plug may wear off owing to a long period of use, causing a very small gap between the glass dome as to form air bubbles in the liquid contained in the glass dome.

SUMMARY OF THE INVENTION

The purpose of the invention is to offer a leakage preventing structure for water ball decorations, including an reinforcing ring fitted and expanding properly a anti-leak rubber plug used in a conventional water ball decoration, augmenting close contact between the anti-leak rubber plug and the glass dome, and thus reinforcing leak preventing function of the rubber plug.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
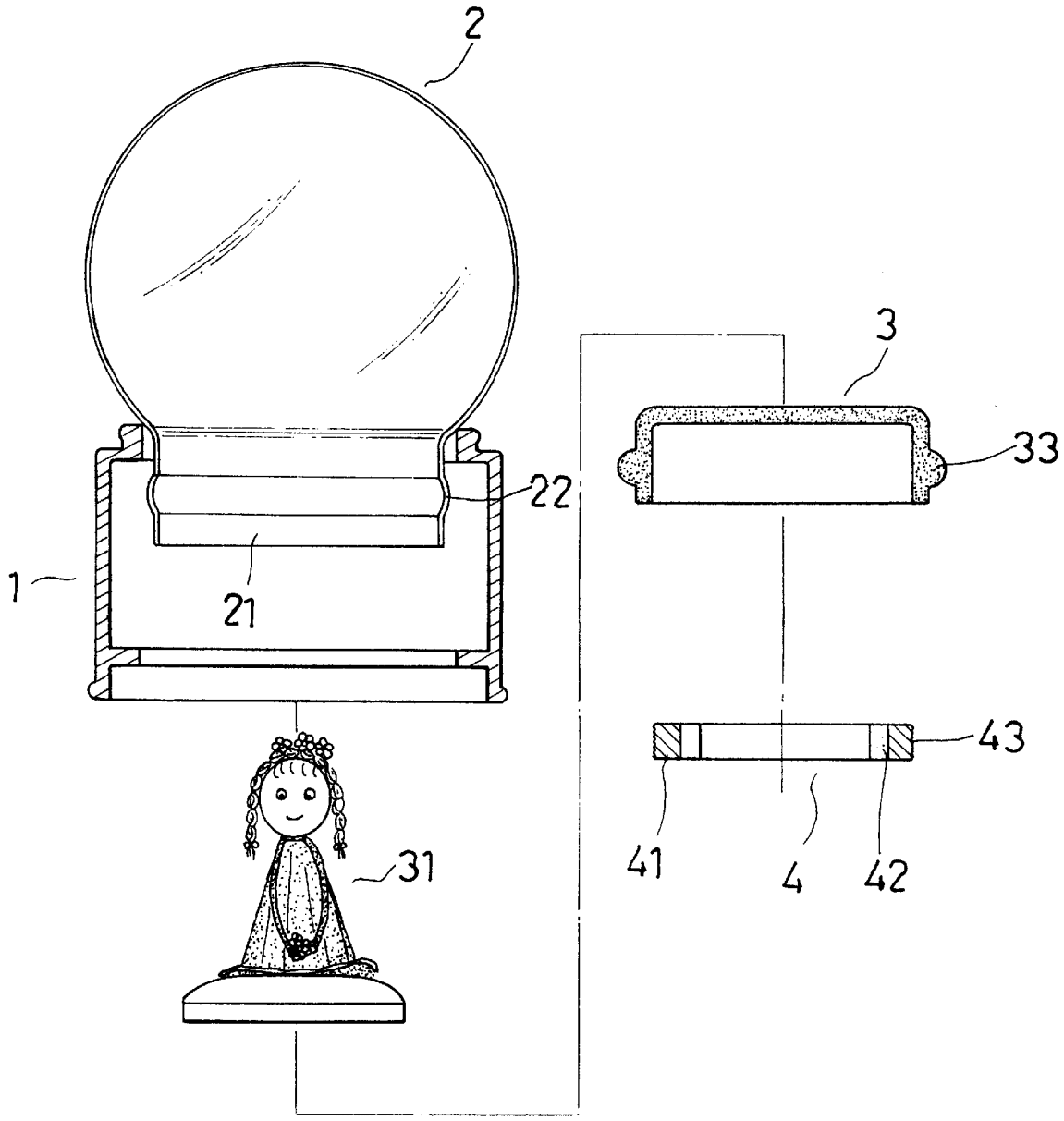
FIG. 1 is an exploded front view of a water ball decoration with a leakage preventing structure of the present invention.

A first preferred embodiment of a leakage preventing structure for water ball decorations, as shown in FIG. 1, includes a reinforcing ring 4 additionally provided in an anti-leak rubber plug 3 in a conventional water ball decoration.

Figure 2:
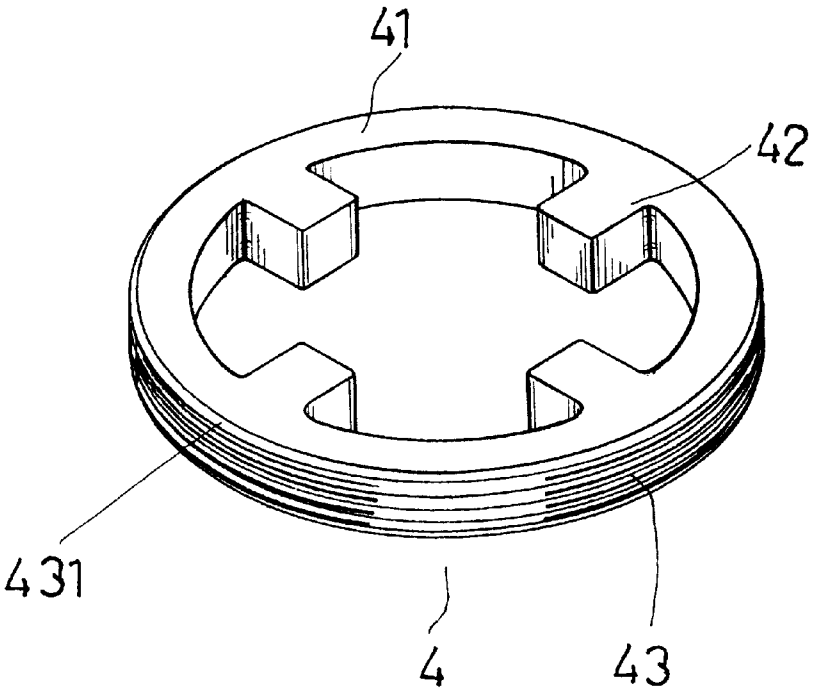
FIG. 2 is a perspective view of a reinforcing ring of the present invention.

As shown in FIGS. 1 and 2, the reinforcing ring 4 has an annular body 41 made of plastic or steel and having an outer diameter a bit larger than an inner diameter of the anti-leak rubber plug 3, a plurality of inner square projections 42 spaced apart equidistantly on an inner surface, and male threads 43 formed on an outer surface. Further, the male threads 43 have its upper end and its lower end formed with a 5-degree radial angle 421.

Figure 4:
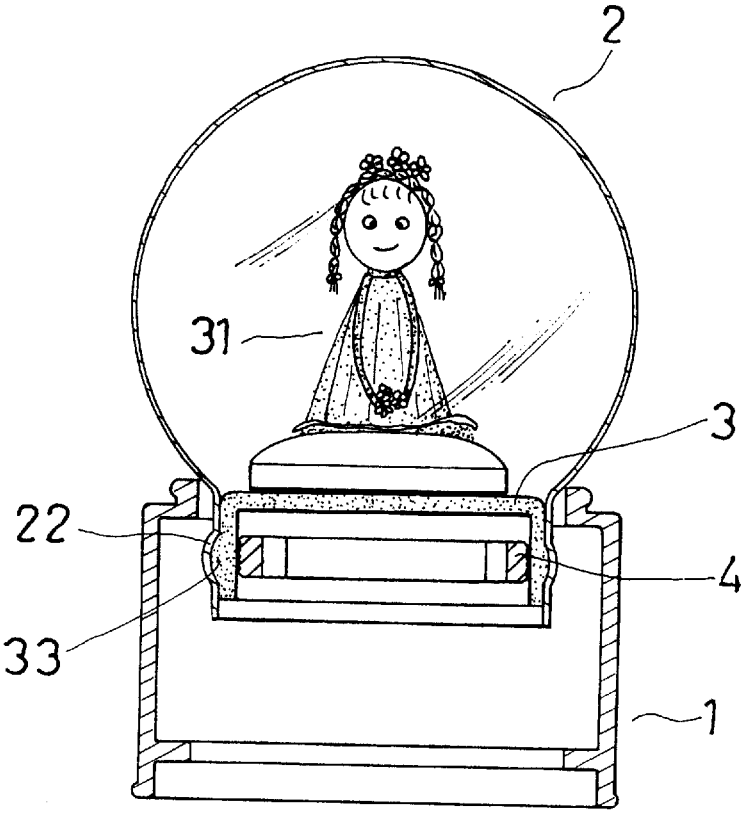
FIG. 4 is a cross-sectional view of the water ball decoration with the leakage preventing structure of the present invention.
Figure 3:
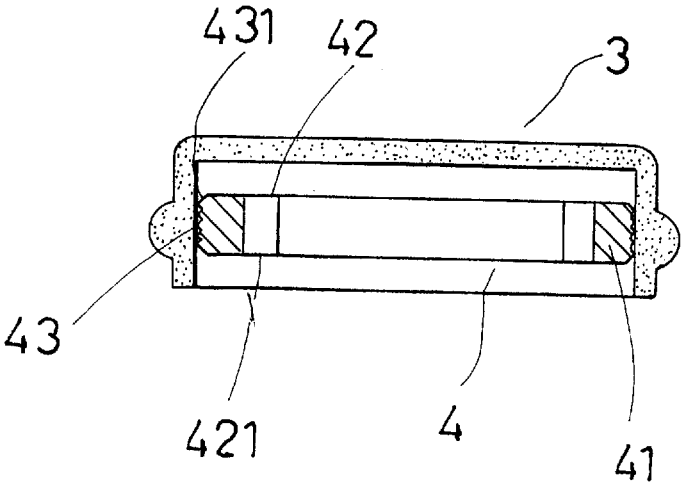
FIG. 3 is a cross-sectional view of the reinforcing ring combined with an anti-leak rubber plug of the present invention.
Figure 6:
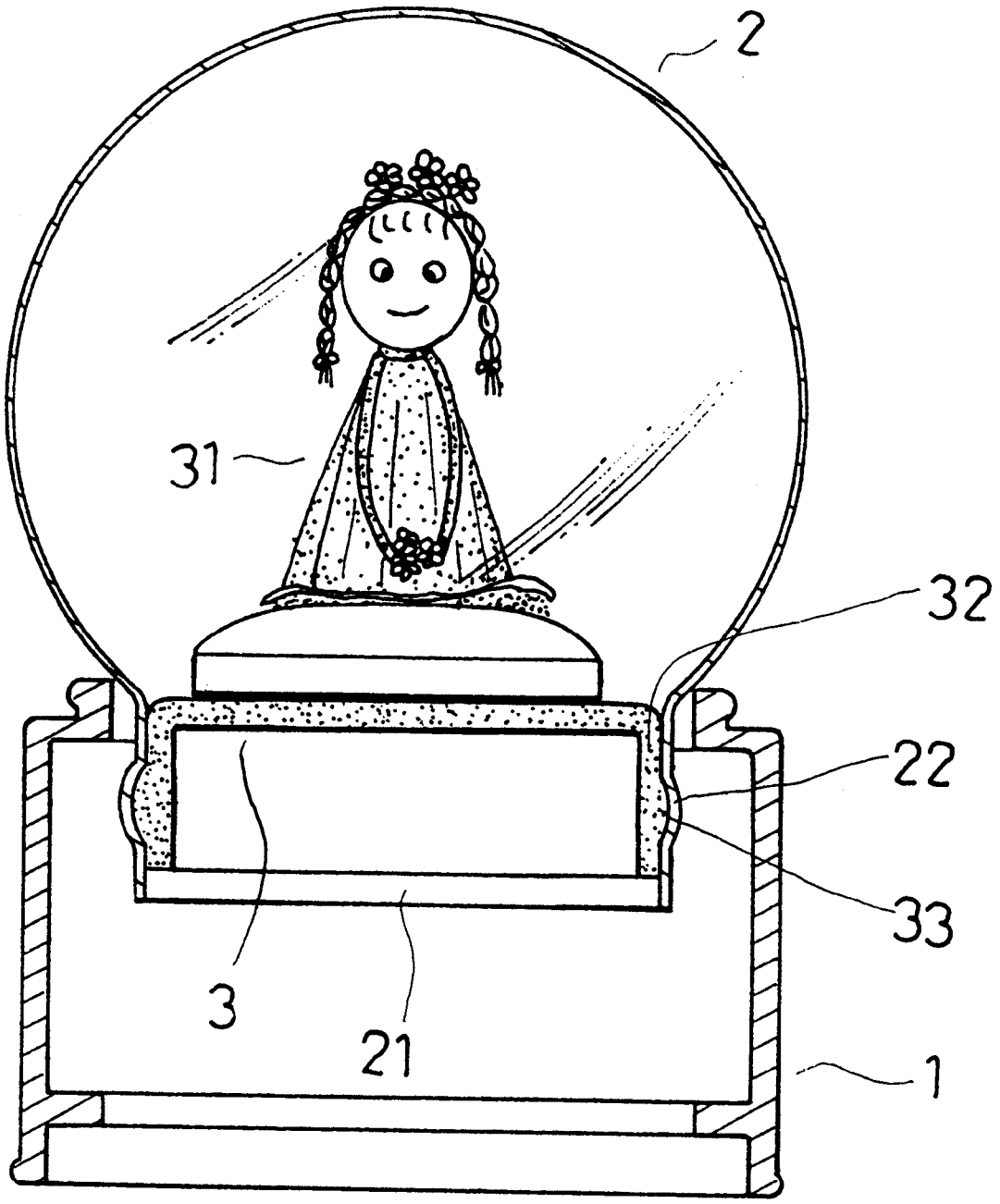
FIG 6 (PRIOR ART)

In assembling, a glass dome 2 is filled with a liquid, and the anti-leak rubber plug 3 is fixed with the glass dome 2. Then the reinforcing ring 4 is fitted and rotated in the rubber plug 3, as shown in FIG. 3, with a tool engaging the inner projections 42 and rotating the reinforcing ring 4 with the threads 43 engaging an inner surface of the rubber plug 3, forcing the rubber plug 3 properly extend outward to tightly contact the lower portion of the glass dome 2. Then a base 1 is combined with the lower portion of the glass dome 2, as shown in FIG. 4, finishing assembling the water ball decoration with the leakage preventing structure of the invention.

Figure 5:
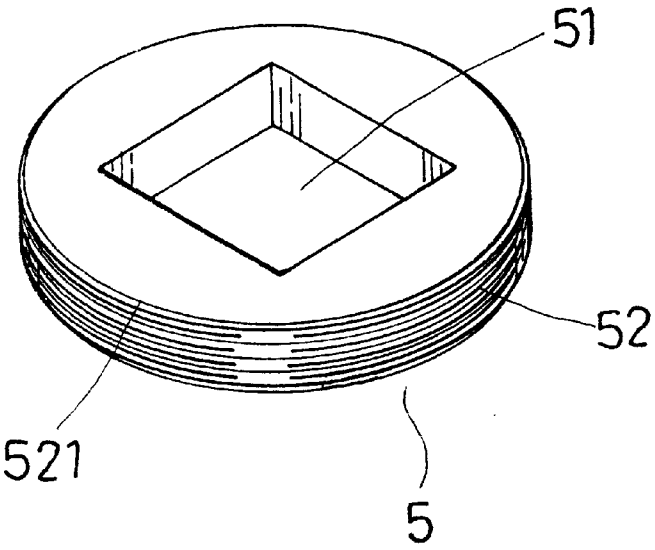
FIG. 5 is an enlarged perspective view of a second preferred embodiment of a reinforcing ring of the present invention; and, FIG. 6 is a cross-sectional view of a conventional water ball decoration.

A second preferred embodiment of a reinforcing ring 5, for utilization in water ball decorations of a small dimensions, is formed with a square center hole 51 and male threads 52 on an outer surface as shown in FIG. 5. Further, the male threads 52 have its upper end and lower end formed with a proper radial angle 521. Therefore, a proper spanner may be used to fit in the square center hole 51 to rotate the reinforcing ring 5 in the rubber plug 3 located in the glass dome 2, obtaining leakage preventing function as the first preferred embodiment.

As can be understood from the above description, a water ball decoration has its glass dome and its anti-leak rubber plug combined water-tight with each other, and an additional reinforcing ring to properly expanding the rubber plug so that the rubber plug may tightly contact the glass dome, reinforcing close combination of the rubber plug with the glass dome and strengthening preventing function of liquid leakage from the glass dome. Consequently, air bubbles may be hampered from forming in the glass dome, lower-ing cost effectively and prolonging service life of the water ball decoration.

While the preferred embodiments of the invention have been described above, it will be recognized and understood that various modifications may be made therein and the appended claims are intended to cover all such modifications which may fall within the spirit and scope of the invention.

What is claimed is:

1. A leakage preventing structure for water ball decorations having a base, a glass dome positioned in the base and having a open lower side, and an anti-leak rubber plug adhered in the open lower side of the glass dome, said leak preventing structure comprising a reinforcing ring for insert into the rubber plug to outwardly expand the rubber plug into tight contact with the glass dome, said reinforcing ring having an annular body with an angle formed on an outer surface of said annular body, and a plurality of square projections formed on an inner annular surface of said reinforcing ring in equidistantly spaced relationship for engagement with with said projections to rotate and fix said reinforcing ring in said rubber plug.

2. A leakage preventing structure for water ball decorations having a base, a glass dome positioned in the base and having a open lower side, and an anti-leak rubber plug adhered in the open lower side of the glass dome, said leak preventing structure comprising a reinforcing ring for insert into the rubber plug to outwardly expand the rubber plug into tight contact with the glass dome, said reinforcing ring being provided with male threads formed on an outer annular surface of said reinforcing ring for more easily rotating and fixing said reinforcing ring in the rubber plug.

3. A leakage preventing structure for water ball decorations having a base, a glass dome positioned in the base and having a open lower side, and an anti-leak rubber plug adhered in the open lower side of the glass dome, said leak preventing structure comprising a reinforcing ring for insert into the rubber plug to outwardly expand the rubber plug into tight contact with the glass dome, said reinforcing ring being provided with a centrally disposed square hole for receiving a spanner therein to rotate and fix said reinforcing ring in said rubber plug.

* * * * *